US005474431A

United States Patent [19]

Fairbanks

[11] Patent Number: 5,474,431

[45] Date of Patent: Dec. 12, 1995

[54] SCROLL MACHINE HAVING DISCHARGE PORT INSERTS

[75] Inventor: Steven C. Fairbanks, Sidney, Ohio

[73] Assignee: Copeland Corporation, Sidney, Ohio

[21] Appl. No.: 333,594

[22] Filed: Nov. 2, 1994

Related U.S. Application Data

[63] Continuation of Ser. No. 153,210, Nov. 16, 1993, abandoned.

[51] Int. Cl.[6] ..... F01C 1/04; F01C 21/00

[52] U.S. Cl. ..... 418/39; 418/55.2; 29/888.022

[58] Field of Search ..... 418/39, 55.1, 55.2, 418/188; 417/238; 29/888.022

[56] References Cited

U.S. PATENT DOCUMENTS

| | | | |
|---|---|---|---|
| Re. 34,148 | 12/1992 | Terauchi et al. | 418/55.1 |
| 1,294,151 | 2/1919 | Page . | |
| 1,639,623 | 11/1924 | White . | |
| 2,700,981 | 2/1955 | McLay et al. . | |
| 4,389,171 | 6/1983 | Eber et al. | 418/15 |
| 4,486,158 | 12/1984 | Maruyama et al. | 418/39 |
| 4,498,852 | 2/1985 | Hiraga | 418/142 |
| 4,505,651 | 3/1985 | Terauchi et al. | 418/55.1 |
| 4,642,034 | 2/1987 | Terauchi | 418/55.1 |
| 4,645,436 | 2/1987 | Sakamoto | 418/55.2 |
| 5,173,042 | 12/1992 | Chambers | 418/55.1 |
| 5,178,520 | 1/1993 | Strelow | 417/62 |
| 5,342,183 | 8/1994 | Rafalovich et al. | 418/55.1 |

FOREIGN PATENT DOCUMENTS

| | | | |
|---|---|---|---|
| 58-65995 | 4/1983 | Japan . | |
| 61-265377 | 11/1986 | Japan | 418/55.1 |
| 3-74589 | 3/1991 | Japan | 418/55.1 |
| 1344668 | 1/1974 | United Kingdom . | |

*Primary Examiner*—John J. Vrablik
*Attorney, Agent, or Firm*—Harness, Dickey & Pierce

[57] ABSTRACT

A scroll machine has a multi-functional device which is attached to either or both of the scroll members that serves the purpose of optimizing or altering the discharge port geometry to a specific compression ratio or for modulation of compression ratios for performance optimization.

18 Claims, 8 Drawing Sheets

SCROLL MACHINE HAVING DISCHARGE PORT INSERTS

This is a continuation of U.S. patent application Ser. No. 08/153,210, filed Nov. 16, 1993, abandoned.

FIELD OF THE INVENTION

The present invention relates generally to scroll machines. More particularly, the present invention relates to scroll machines having discharge port inserts for changing the size and/or shape of the discharge port.

BACKGROUND AND SUMMARY OF THE INVENTION

Scroll machinery for fluid compression or expansion is typically comprised of two upstanding interfitting involute spirodal wraps or scrolls which are generated about respective axes. Each respective scroll is mounted upon an end plate and has a tip disposed in contact or near contact with the end plate of the other respective scroll. Each scroll further has flank surfaces which adjoin, in moving line contact or near contact, the flank surfaces of the other respective scroll to form a plurality of moving chambers. Depending upon the relative orbital motion of the scrolls, the chambers move from the radially exterior ends of the scrolls to the radially interior ends of the scrolls for fluid compression, or from the radially interior ends of the scrolls to the radially exterior ends of the scrolls for fluid expansion. The scrolls, to accomplish the formation of the chambers, are put in relative orbital motion by a drive mechanism. Either one of the scrolls may orbit or both may rotate eccentrically with respect to one another.

A typical scroll machine, according to the design which has a non-orbiting scroll, includes an orbiting scroll which meshes with the non-orbiting scroll, a thrust bearing to take the axial loads on the orbiting scroll, a motion control member for preventing relative rotation of the scroll members and a lubricant supply system for lubricating the various moving components of the machine including the thrust bearing.

Scroll machines are currently used in a variety of applications and markets including refrigeration, air conditioning and heat pump applications. Each particular application or market is sensitive to specific operating points of the compressor. In applications where the ambient temperature conditions vary, as in outdoor applications, the compressor must be designed to operate at a median temperature and thus run somewhat inefficient when ambient temperatures are at their extremes.

Accordingly, it would be advantageous to be able to optimize scroll machinery performance to particular markets without incurring the high costs of manufacturing a specific design of compressor for each particular market.

It is therefore a primary objective of the present invention to provide for the attachment of a multi-functional device to either or both of the non-orbiting and orbiting scrolls that serves the purpose of optimizing or altering the discharge port geometry to a specific compression ratio, or for modulation of compression ratios for performance optimization. The ability to incorporate such a device into the scroll machinery after a generic discharge port has been machined into the scrolls would allow for the cost effective machining and assembly of the scroll machinery, a cost effective method of optimizing scroll performance to particular markets which are sensitive to specific operating points, and a way to add features to modulate the performance or efficiency of the scroll machinery within an application based on changing indoor and outdoor ambient temperature conditions.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
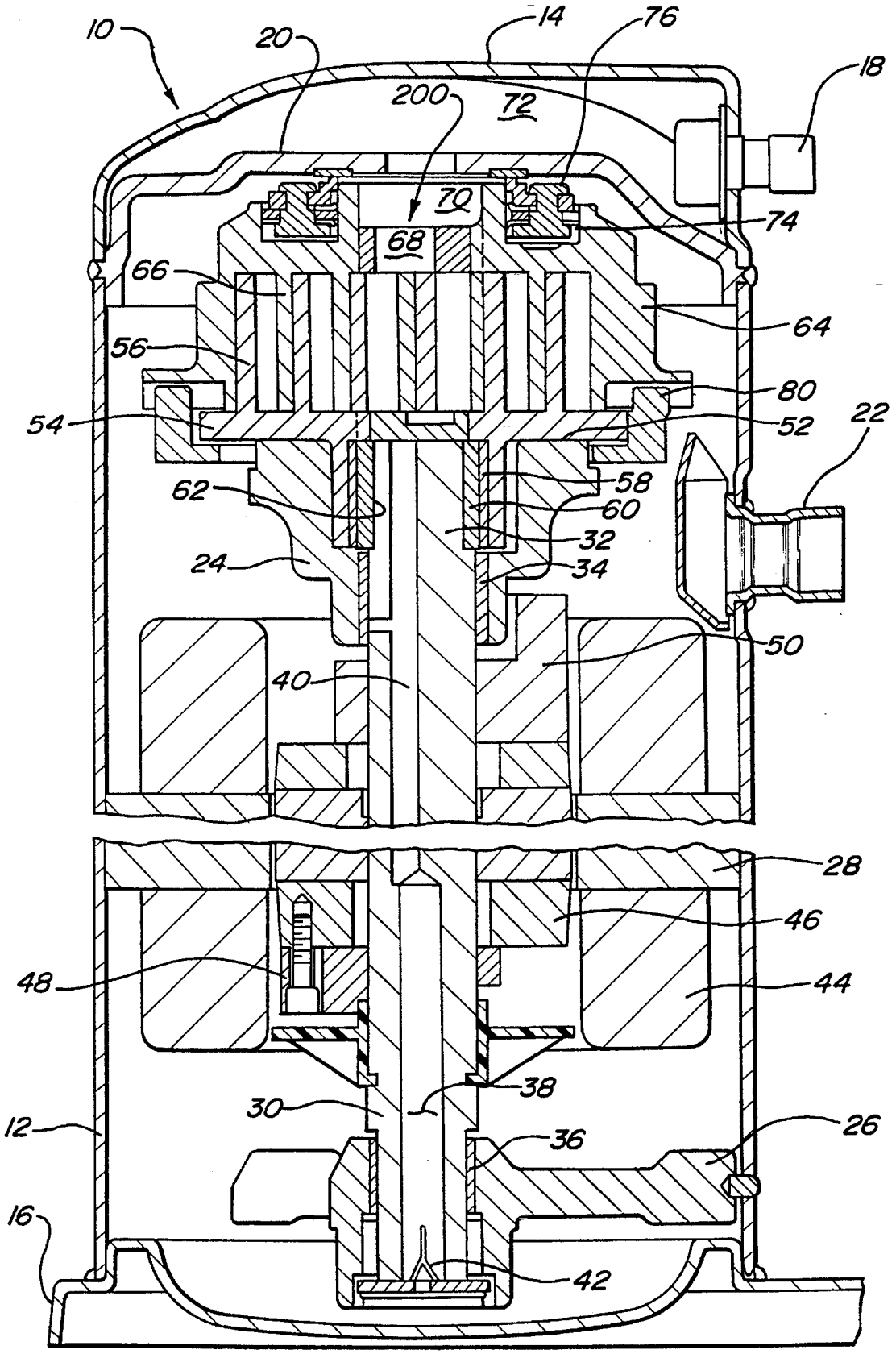
FIG. 1 is a vertical sectional view through the center of a scroll type refrigeration compressor incorporating a discharge port insert in accordance with the present invention.

Referring now to the drawings in which like reference numerals designate like or corresponding parts throughout the several views, there is shown in FIG. 1, a compressor 10 which comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 20 which is welded about its periphery at the same point that cap 14 is welded to shell 12, an inlet fitting 22, a main bearing housing 24 which is suitably secured to shell 12 and a lower bearing housing 26 having a plurality of radially outwardly extending legs each of which is suitably secured to shell 12. A motor stator 28 which is generally square in cross-section but with the corners rounded off is press fitted into shell 12. The flats between the rounded corners on the stator provide passageways between the stator and shell which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 is filled with lubricating oil and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 44 passing therethrough and a motor rotor 46 press fitted on crankshaft 30 and having upper and lower counterweights 48 and 50, respectively.

The upper surface of main bearing housing 24 is provided with a flat thrust bearing surface 52 on which is disposed an orbiting scroll 54 having the usual spiral vane or wrap 56 on the upper surface thereof. Projecting downwardly from the lower surface of orbiting scroll 54 is a cylindrical hub having a journal bearing 58 therein and in which is rotatively disposed a drive bushing 60 having an inner bore 62 in which crank pin 32 is drivingly disposed. Crank pin 32 has a flat on one surface which drivingly engages a flat surface (not shown) formed in a portion of inner bore 62 to provide a radially compliant driving arrangement, such as shown in assignee's U.S. Pat. No. 4,877,382, the disclosure of which is hereby incorporated herein by reference.

A non-orbiting scroll member 64 is also provided having a wrap 66 positioned in meshing engagement with wrap 56 of scroll 54. Non-orbiting scroll 64 has a discharge passage 68 which communicates with an upwardly open recess 70 which in turn is in fluid communication with a discharge muffler chamber 72 defined by cap 14 and partition 20. An annular recess 74 is also formed in non-orbiting scroll 64 within which is disposed a seal assembly 76. Recesses 70 and 74 and seal assembly 76 cooperate to define axial pressure biasing chambers which receive pressurized fluid being compressed by wraps 56 and 66 so as to exert an axial biasing force on non-orbiting scroll member 64 to thereby urge the tips of respective wraps 56 and 66 into sealing engagement with the opposed end plate surfaces. Seal assembly 76 is preferably of the type described in greater detail in U.S. Pat. No. 5,156,539, the disclosure of which is hereby incorporated herein by reference. Scroll member 64 is designed to be mounted to main bearing housing 24 in a suitable manner such as disclosed in the aforementioned U.S. Pat. No. 4,877,382 or U.S. Pat. No. 5,102,316, the disclosure of which is hereby incorporated herein by reference.

An Oldham coupling 80 is also provided positioned between orbiting scroll 54 and main bearing housing 24. Oldham coupling 80 is keyed to both orbiting scroll 54 and non-orbiting scroll 64 to prevent rotational movement of orbiting scroll member 54 with respect to non-orbiting scroll 64. Oldham coupling 80 is preferably similar to the type disclosed in assignee's copending application Ser. No. 591,443, entitled "Oldham Coupling For Scroll Compressor" filed Oct. 1, 1990, the disclosure of which is hereby incorporated herein by reference.

The compressor is preferably of the "low side" type in which suction gas entering via gas inlet 22 is allowed, in part, to escape into shell 12 and assist in cooling the motor. So long as there is an adequate flow of returning suction gas, the motor will remain within desired temperature limits. When this flow drops significantly, however, the loss of cooling will eventually cause a temperature sensor to signal the control device to shut the machine down.

The scroll compressor as thus far broadly described is either now known in the art or is the subject matter of other pending applications for patent by applicant's assignee. The details of construction which incorporate the principles of the present invention are those which deal with a unique discharge port insert system, indicated generally at 200.

Figure 2:
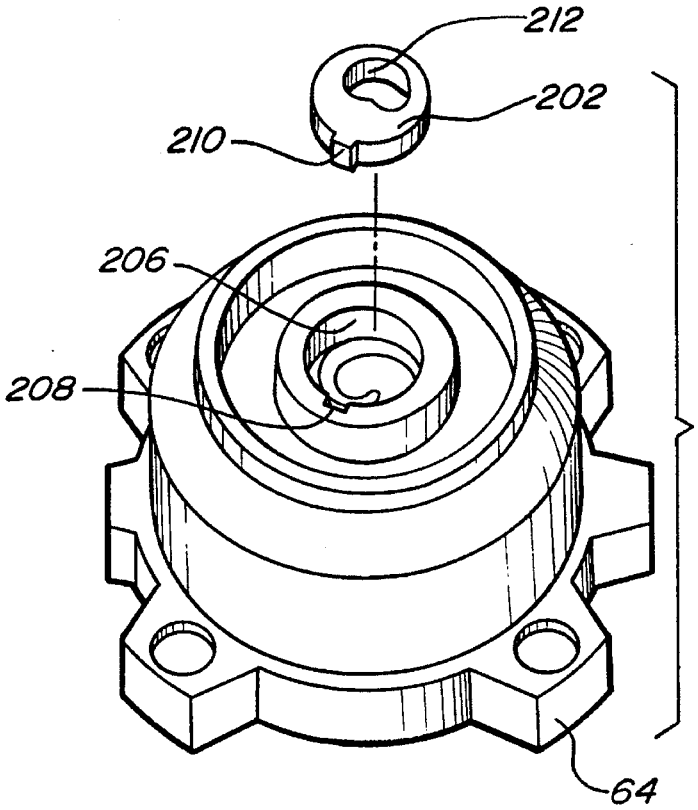
FIG. 2 is a perspective view of the non-orbiting scroll of the scroll compressor shown in FIG. 1 showing the removable discharge port insert for the non-orbiting scroll of the present invention.
Figure 3:
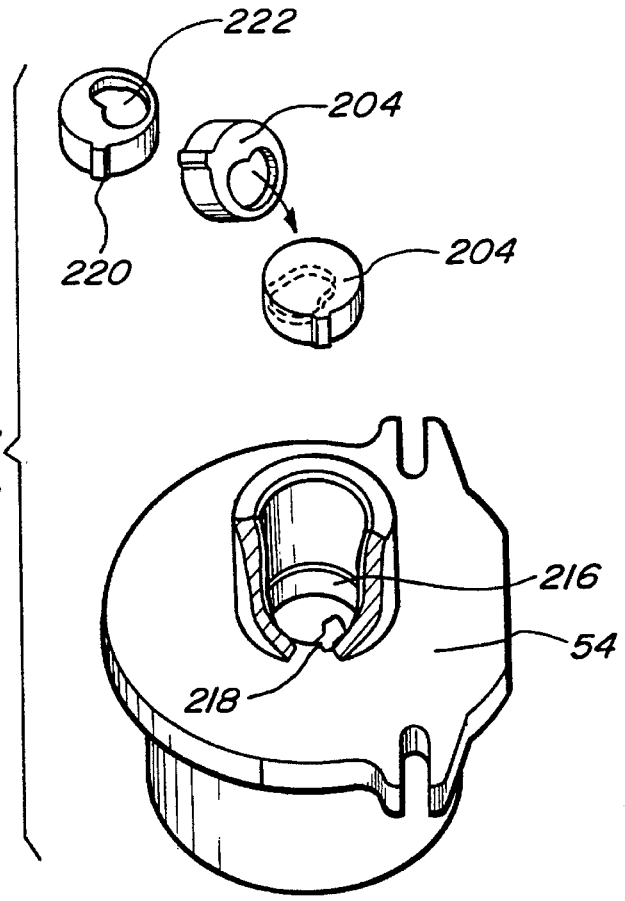
FIG. 3 is a perspective view of the orbiting scroll of the scroll compressor shown in FIG. 1 showing the removable discharge port insert for the orbiting scroll of the present invention.

Discharge port insert system 200, as best shown in FIGS. 2 and 3, comprises non-orbiting scroll 64, a non-orbiting scroll insert 202, orbiting scroll 54 and orbiting scroll insert 204. Non-orbiting scroll 64, shown in FIG. 2, has a generic discharge port 206 machined into its end plate. Discharge port 206 includes a radial notch 208 which locates and prohibits the rotation of insert 202 as will be described later herein.

Scroll insert 202 has an exterior configuration adapted to mate with discharge port 206. Scroll insert 202 includes a radially extending tab 210 which fits within radial notch 208 to locate and prohibit rotation of insert 202 with respect to non-orbiting scroll 64 when insert 202 is assembled into discharge port 206. Scroll insert 202 also includes a discharge opening 212 which extends through insert 202 and defines discharge passage 68. The shape of opening 212 may be tailored to any of the various requirements of the operating environment of the compressor and as shown in FIG. 2, discharge opening 212 is preferably of a non-circular configuration which is in a non-concentric relationship to the outside diameter of insert 202 thus shifting the effective center line of discharge passage 68 from the center line of generic discharge port 206. In order to insure that compressed gas will enter the discharge chamber only through discharge opening 212, it is necessary to maintain a sealed relationship between insert 202 and non-orbiting scroll 64. Scroll insert 202 is assembled into discharge port 206 of non-orbiting scroll member 64 and is secured to non-orbiting scroll member 64 by press fitting, shrink fitting, epoxy, bolt or screw, weld, rivet or orbital rivet, or by any other means known well in the art. Tab 210 fits within notch 208 to both properly position discharge opening 212 circumferentially as well as insuring against any type of rotational movement of insert 202 within port 206.

Thus it can be seen that a single non-orbiting scroll can be manufactured for virtually all of the various market requirements and the individual compressors can then be tailored to the individual markets by incorporating an insert 202 having the appropriate discharge opening 212.

It is not uncommon in the manufacture of scroll compressors to provide orbiting scroll 54 with a discharge passageway corresponding with the discharge passageway located in non-orbiting scroll 64. The incorporation of the discharge passageway within orbiting scroll 54 insures symmetrical opening of the compression chambers into the discharge area of the compressor. Orbiting scroll member 54, shown in FIG. 3, also has a generic discharge port 216 machined into its end plate. Discharge port 216 includes a radial notch 218 which locates and prohibits the rotation of insert 204 as will be described later herein.

Scroll insert 204, shown in multiple positions in FIG. 3 for ease of understanding, has an exterior surface configuration adapted to mate with discharge port 216. Scroll insert 204 includes a radially extending tab 220 which fits within radial notch 218 to locate and prohibit rotation of insert 204 with respect to orbiting scroll 54 when insert 204 is assembled into discharge port 216. Scroll insert 204 also includes a discharge opening 222 which extends partially into insert 204. Discharge opening 222 is similar in shape to discharge opening 212 in insert 202. Discharge opening 222 only extends partially into insert 204 due to the fact the side of insert 204 into which discharge opening 222 extends is exposed to discharge pressure and the opposite side of insert 204 is exposed to suction pressure. It is therefore necessary to maintain a fluid tight relationship through insert 204 as well as between insert 204 and orbiting scroll 54.

The shape of discharge opening 222 corresponds with the shape of discharge opening 212 and thus they both may be tailored to the various requirements of the operating environment of the compressor. Scroll insert 204 is assembled into discharge port 216 of orbiting scroll member 54 and is secured to orbiting scroll member 54 by press fitting, shrink fitting, epoxy, bolt or screw, weld, rivet or orbital rivet, or by other means known well in the art. Tab 220 fits within notch 218 to both properly position discharge opening 222 circumferentially as well as insuring against any type of rotational movement of insert 204 with respect to port 216.

Thus it can be seen that identical to non-orbiting scroll 64, a single orbiting scroll can be manufactured for virtually all of the various market requirements and the individual compressor can then be tailored to the individual markets by incorporating an insert 204 having the appropriate discharge opening 222. The use of insert 204 within orbiting scroll 54 may or may not be used in conjunction with insert 202 within non-orbiting scroll 64 in order to tailor the compressor to a specified requirement.

Figure 4:
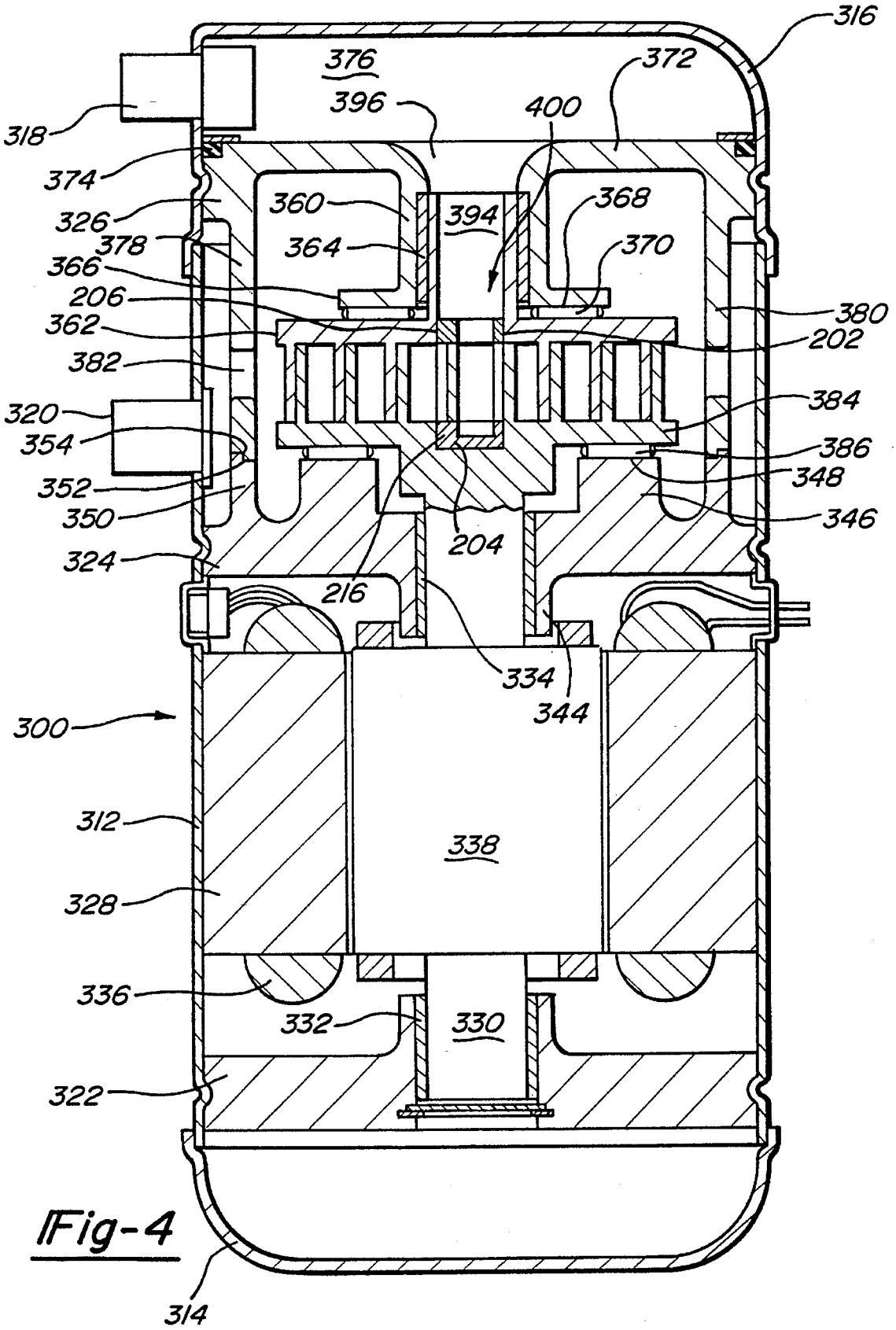
FIG. 4 is a schematic view of a dual rotating scroll compressor incorporating a discharge port insert in accordance with the present invention.

Referring now to FIG. 4, there is shown a scroll compressor 300 incorporating the discharge port insert system of the present invention. Compressor 300 comprises a cylindrical hermetic shell 312 having welded at the lower end thereof a cover 314 and at the upper end thereof a cap 316. Cap 316 is provided with a refrigerant discharge fitting 318 optionally having the usual discharge valve therein (not shown). Other members affixed within the hermetic shell formed by shell 312, cover 314 and cap 316 include a suction gas inlet fitting 320, a lower bearing housing 322, an intermediate bearing housing 324, an upper bearing housing 326 and a motor stator 328. Lower bearing housing 322 is affixed to shell 312 at its outer periphery by methods known well in the art.

A crankshaft 330 is rotatably journaled in a bearing 332 located in lower bearing housing 322 and in a bearing 334 located in intermediate bearing housing 324. Similar to the compressor shown in FIG. 1, crankshaft 330 has the usual oil pumping bores (not shown) and the lower portion of cylindrical shell 312 is filled with lubricating oil in the usual manner and the pump located within crankshaft 330 is the primary pump which pumps lubricating fluid to all the various portions of compressor 300 which require lubrication. Crankshaft 330 is rotatably driven by an electric motor including motor stator 328 having motor windings 336 passing therethrough, and a motor rotor 338 press fit on crankshaft 330.

Intermediate bearing housing 324 has a generally cylindrical shaped central portion 344 within which the upper end of crankshaft 330 is rotatably supported by bearing 334. An upstanding annular projection 346 is provided on intermediate bearing housing 324 adjacent the outer periphery of central portion 344 and includes an upwardly facing bearing surface 348. An annular section 350 extends generally radially outwardly from annular projection 346 and includes a step 352 which is designed to mate with a corresponding step 354 provided on upper bearing housing 326 for aiding in radially positioning upper bearing housing 326 with respect to intermediate bearing housing 324. The exterior surface of annular section 350 is adapted for mating with shell 3 12 to fixedly secure intermediate bearing housing 324 within shell 312 by methods well known in the art.

Upper bearing housing 324 has a generally cylindrical shaped central portion 360 within which an upper scroll member 362 is rotatably supported by a bearing 364. An annular flange 366 extends radially outward from the lower end of central portion 360 to provide a bearing surface 368 for upper scroll member 362. A bearing 370 is positioned between bearing surface 368 and upper scroll member 362. An annular wall 372 extends radially outward from the upper end of central portion 360 and is fixedly secured at its periphery to shell 312 by means known well in the art. A seal 374 seals the upper discharge zone 376 from the lower suction zone 378. A generally cylindrical section 380 extends downward from annular wall 372 and includes step 354 which matingly engages step 352. A plurality of apertures 382 are provided through cylindrical section 380 to allow gas at suction pressure to enter the compressor section.

A lower scroll 384 is fixedly secured for rotation to crankshaft 330 and is supported on bearing surface 348 by a bearing 386. Lower scroll 384 is intermeshed with upper scroll 362 and both upper and lower scrolls 362 and 384 rotate together, but on different axes, whereby the spiral wraps will create pockets of progressively decreasing volume from suction zone 378 to discharge zone 376. Upper scroll 362 has a centrally disposed discharge passageway 394 communicating with discharge zone 376 through an opening 396 in upper bearing housing 322.

The scroll compressor as thus far broadly described is either now known in the art or is the subject matter of other pending applications for patent by applicant's assignee. The details of construction which incorporate the principles of the present invention are those which deal with a unique discharge port insert system, indicated generally at 400. The discharge port insert system 400 of the present invention is identical to discharge port insert system 200 except that the various scroll inserts are now adapted for assembling with scroll members 362 and 384, both of which rotate. Upper scroll 362 is provided with generic port 206 and insert 202 is fixedly secured within port 206. Lower scroll 384 is provided with generic port 216 and insert 204 is fixedly secured within port 216.

FIGS. 5 through 10 illustrate another embodiment of the present invention. The embodiment shown in FIGS. 1 through 4 above illustrate an insert which has a defined shape for the discharge opening. The embodiment shown in FIGS. 5 through 10 uses inserts to modify the shape of the generic discharge passageway.

Figure 5:
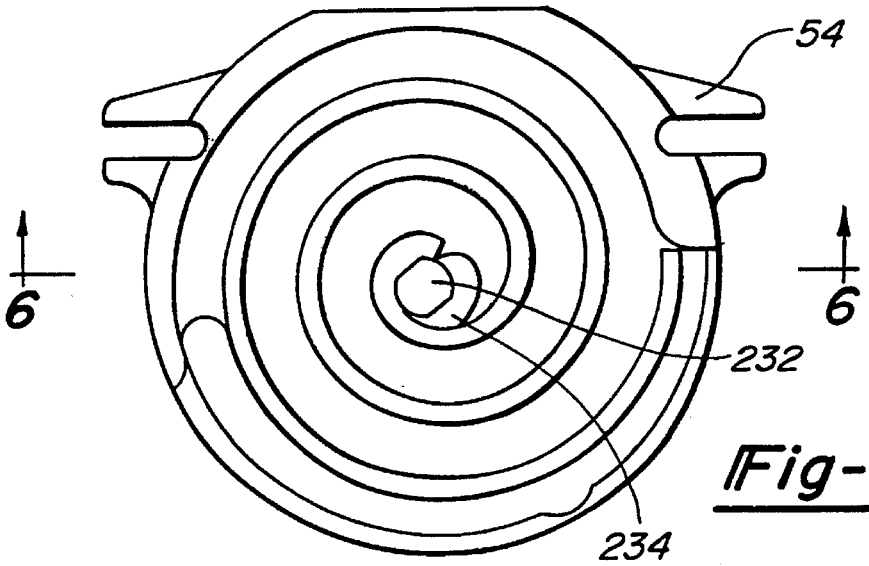
FIG. 5 is a plan view of an orbiting scroll of the scroll compressor shown in FIG. 1 according to another embodiment of the present invention.
Figure 6:
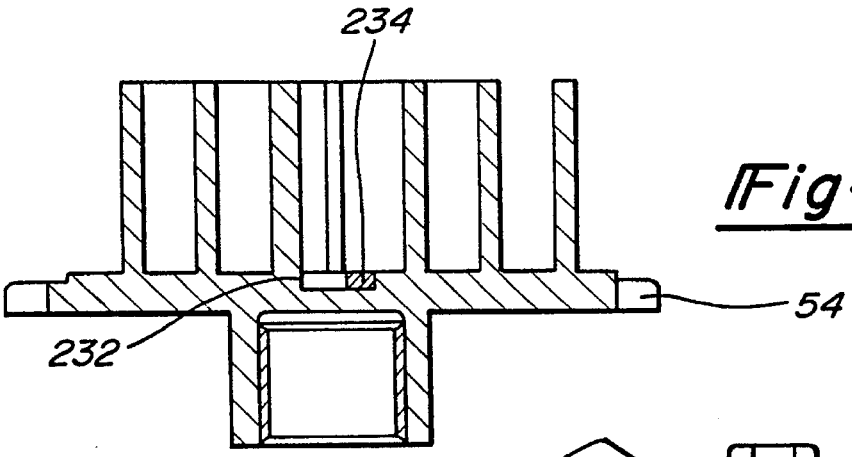
FIG. 6 is a vertical sectional view of the orbiting scroll shown in FIG. 5 taken along line 6—6 in FIG. 5.

FIGS. 5 and 6 illustrate orbiting scroll member 54 which has a discharge opening 232 extending partially into the end plate of orbiting scroll member 54. An insert 234 is fixedly secured within discharge opening 232 to modify the shape of opening 232 and tailor the opening for a specified operating condition.

Figure 7:
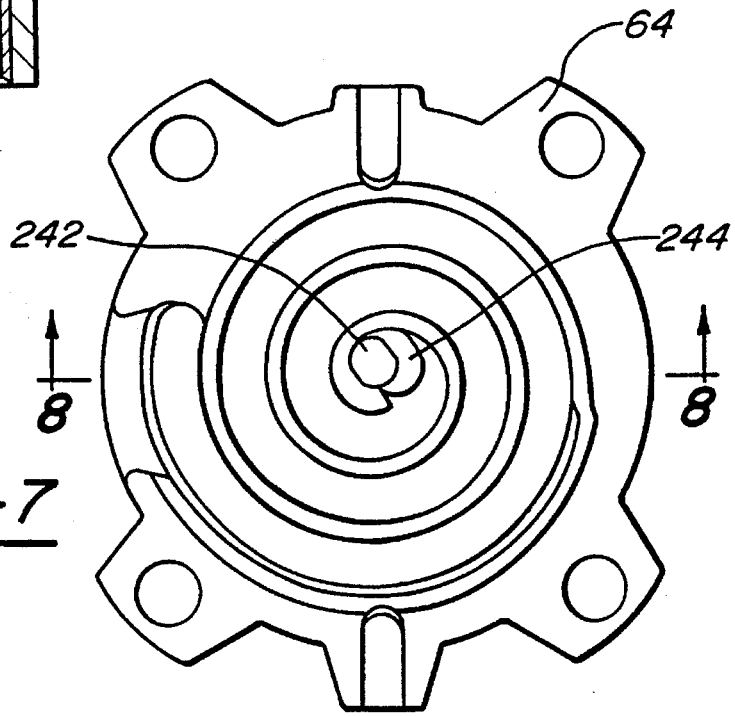
FIG. 7 is a plan view of the non-orbiting scroll designed to mate with the orbiting scroll shown in FIG. 5.
Figure 8:
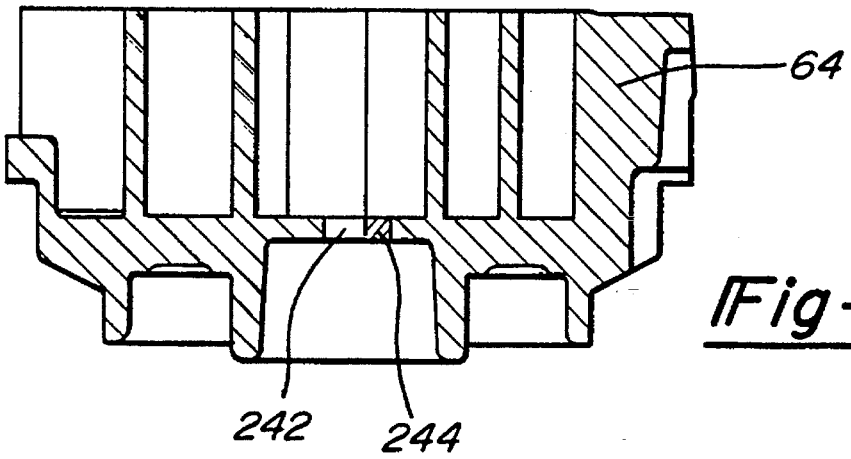
FIG. 8 is a vertical sectional view of the non-orbiting scroll shown in FIG. 7 taken along line 8—8 in FIG. 7.

Likewise, FIGS. 7 and 8 show non-orbiting scroll member 64 which has a discharge opening 242 extending completely through the end plate of non-orbiting scroll member 64. An insert 244 is fixedly secured within discharge opening 242 to modify the shape of opening 242 and tailor the opening for a specified operating condition. When insert 244 is utilized in conjunction with insert 234 in orbiting scroll member 54, the shape of inserts 234 and 224 are chosen to meet the performance requirements of the compressor.

Figure 9:
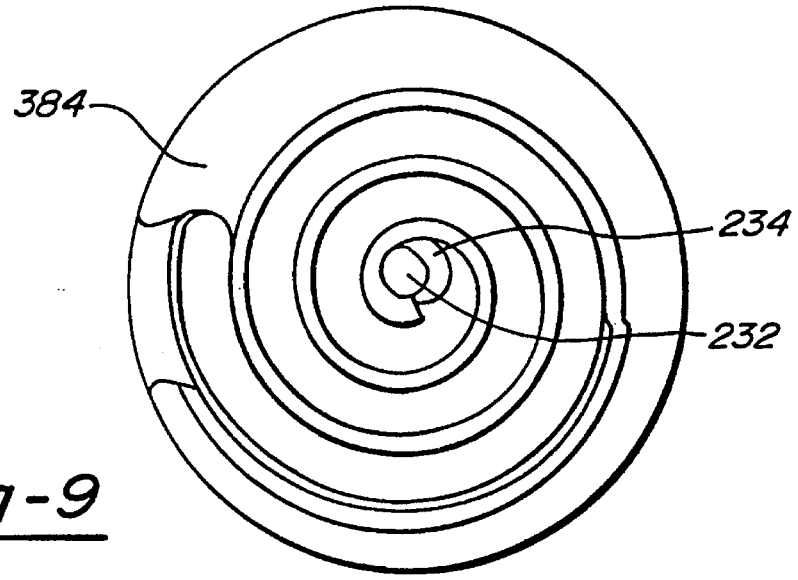
FIG. 9 is a plan view of the lower scroll of the dual rotating scroll of the scroll compressor shown in FIG. 4 according to another embodiment of the present invention.
Figure 10:
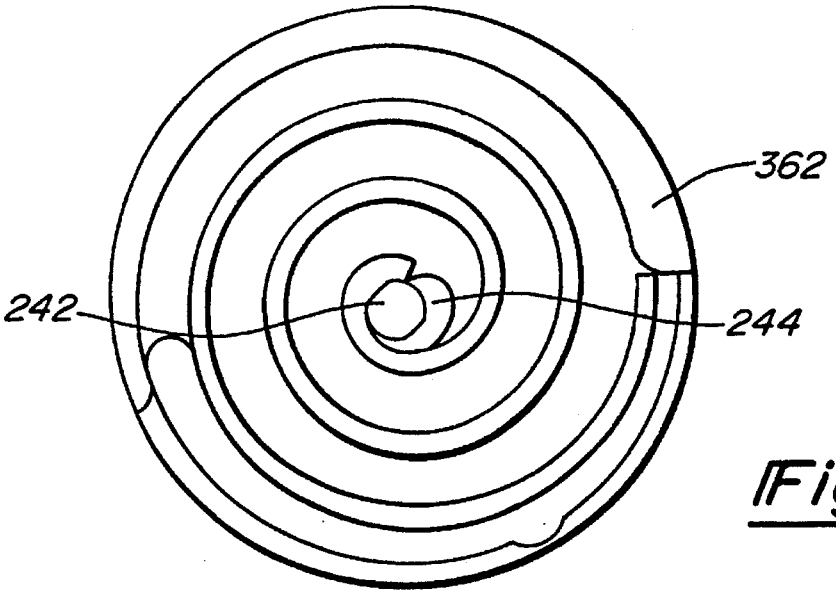
FIG. 10 is a plan view of the upper scroll of the dual rotating scroll of the scroll compressor shown in FIG. 4 according to another embodiment of the present invention.

FIG. 9 shows lower scroll 384 of compressor 300 having insert 234 fixedly secured within discharge opening 232 to modify the shape of opening 232 and tailor the opening for a specified operating condition. FIG. 10 shows upper scroll 362 of compressor 300 having insert 244 fixedly secured within discharge opening 242 to modify the shape of opening 232 and tailor the opening for a specified operating condition. When insert 244 is utilized in conjunction with insert 234 in lower scroll 384, the shape of inserts 244 and 234 are chosen to meet the performance requirements of the compressor.

FIGS. 11 through 18 illustrate another embodiment of the present invention. The embodiment shown in FIGS. 1 through 4 above illustrates an insert which has a defined shape for the discharge openings. The embodiment shown in FIGS. 11 through 18 uses a series of inserts which fit within bores extending into the end plates of the scrolls to define and modify the shape of the discharge opening.

Figure 11:
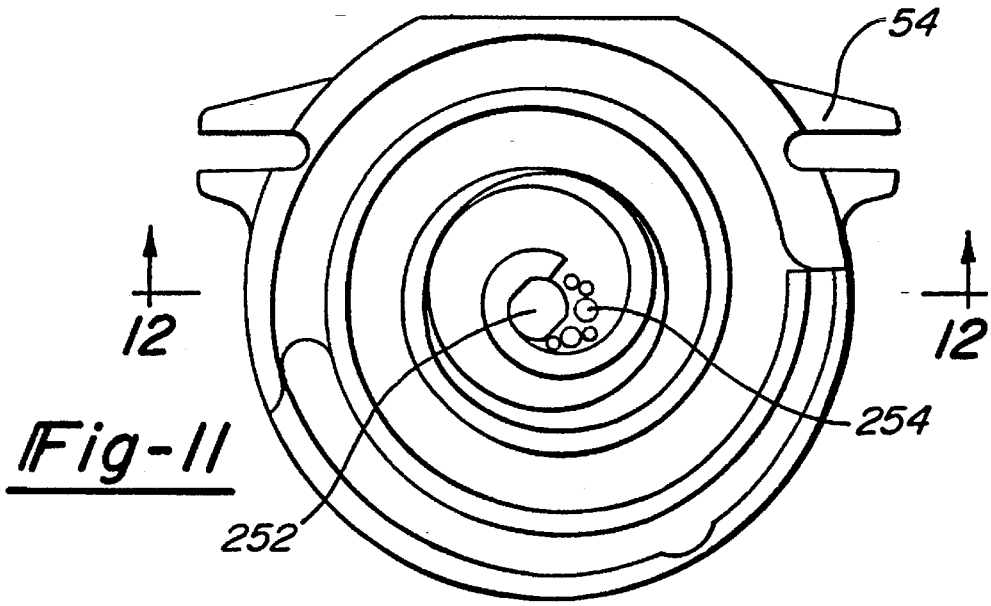
FIG. 11 is a plan view of an orbiting scroll of the scroll compressor shown in FIG. 1 according to another embodiment of the present invention.
Figure 12:
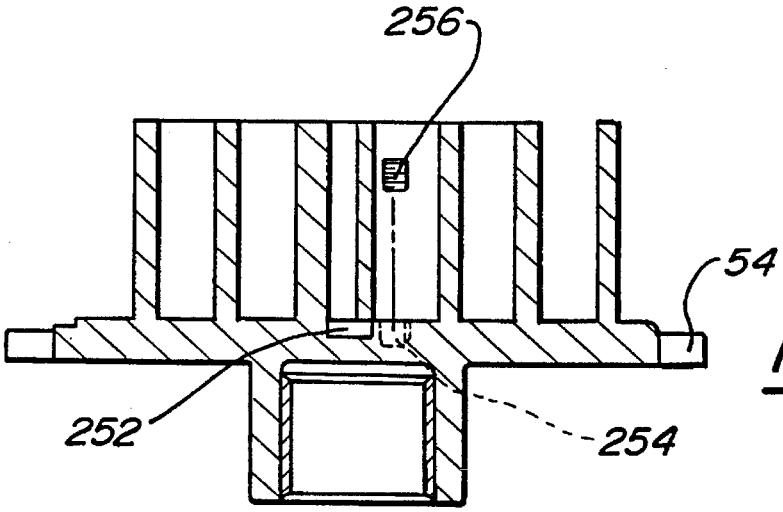
FIG. 12 is a vertical sectional view of the orbiting scroll shown in FIG. 11 taken along line 12—12 in FIG. 11.
Figure 13:
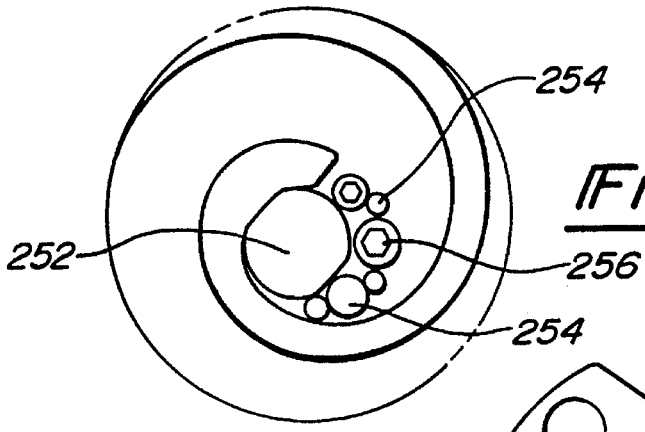
FIG. 13 is an enlarged view showing the discharge port area of the orbiting scroll shown in FIG. 11.

FIGS. 11 through 13 illustrate orbiting scroll member 54 which has a discharge opening 252 extending into the end plate of orbiting scroll member 54. A plurality of discharge cavities 254 also extend partially into the end plate of orbiting scroll member 54 and are positioned adjacent to discharge opening 252. Associated with each of the plurality of discharge cavities 254 is an insert 256. Inserts 256 are adapted to be secured within a respective cavity 254 by being press fit, threaded or by other means known well in the art. The shape of the discharge opening of the compressor can be easily modified by assembling various inserts 256 within their associated cavities 254. Thus the discharge opening can be tailored from a minimum size of opening 252 when all of inserts 256 are present, to a maximum size which includes opening 252 and the sum of the plurality of cavities 254 when all of inserts 256 are removed.

Figure 14:
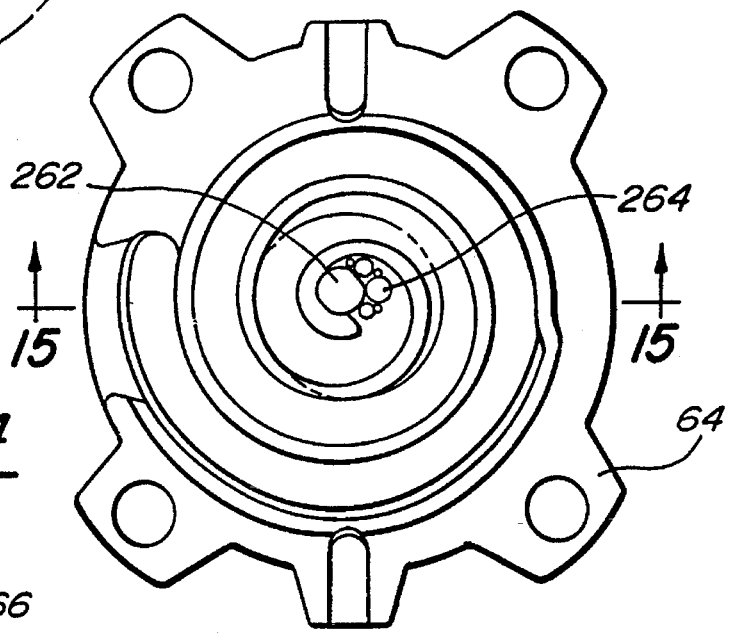
FIG. 14 is a plan view of the non-orbiting scroll designed to mate with the orbiting scroll shown in FIG. 11.
Figure 15:
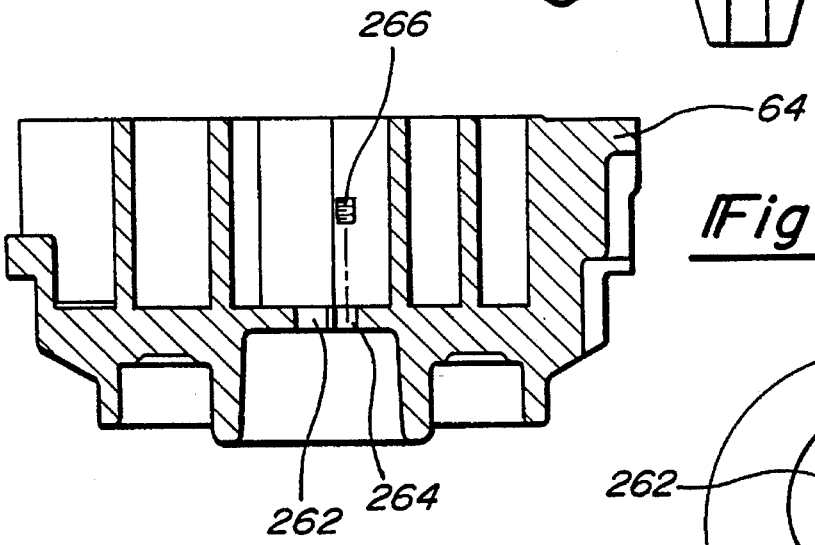
FIG. 15 is a vertical sectional view of the non-orbiting scroll shown in FIG. 14 taken along line 15—15 in FIG. 14.
Figure 16:
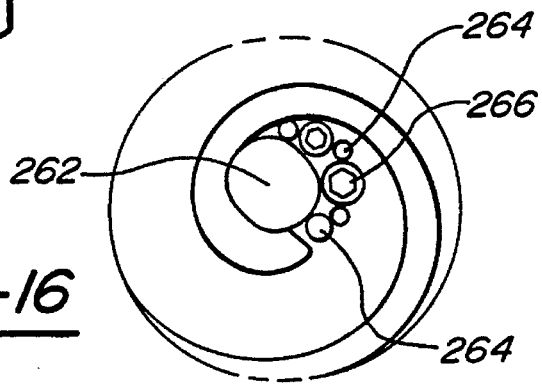
FIG. 16 is an enlarged view showing the discharge port area of the non-orbiting scroll shown in FIG. 14.

FIGS. 14 through 16 illustrate non-orbiting scroll member 64 which has a discharge opening 262 extending through the end plate of scroll member 64. A plurality of discharge cavities 264 also extend through the end plate of orbiting scroll member 64 and are positioned adjacent to discharge opening 262. Associated with each of the plurality of discharge cavities 264 is an insert 266. Inserts 266 are adapted to be secured within a respective cavity 264 by being press fit, threaded or by other means known well in the art. The shape of the discharge opening of the compressor can be easily modified by assembling various inserts 266 within their associated cavities 264. Thus the discharge opening can be tailored from a minimum size of opening 262 when all of inserts 266 are present, to a maximum size which includes opening 262 and the sum of the plurality of cavities 264 when all inserts 266 are removed. The use of inserts 266 within non-orbiting scroll 64 can be the same as or different than the use of inserts 256 within orbiting scroll 54 in order to tailor the compressor to a specific requirement.

Figure 17:
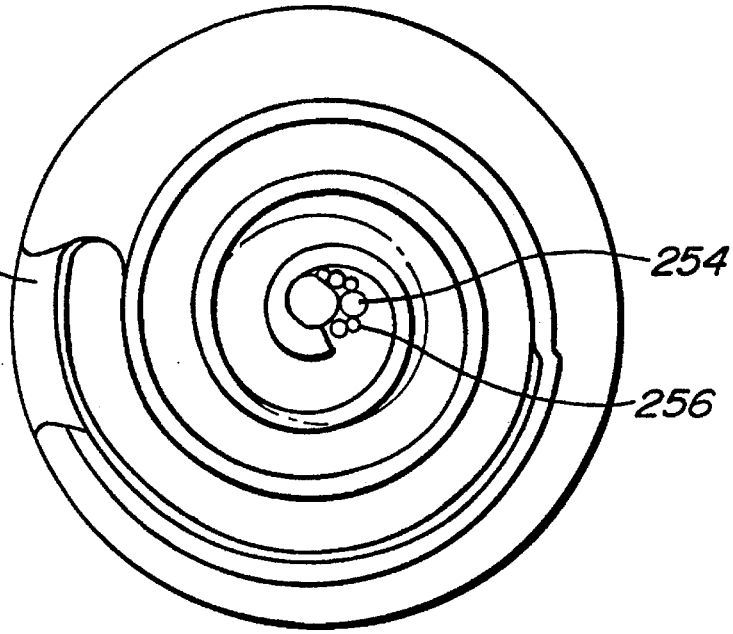
FIG. 17 is a plan view of the lower scroll of the dual rotating scroll of the scroll compressor shown in FIG. 4 according to another embodiment of the present invention.
Figure 18:
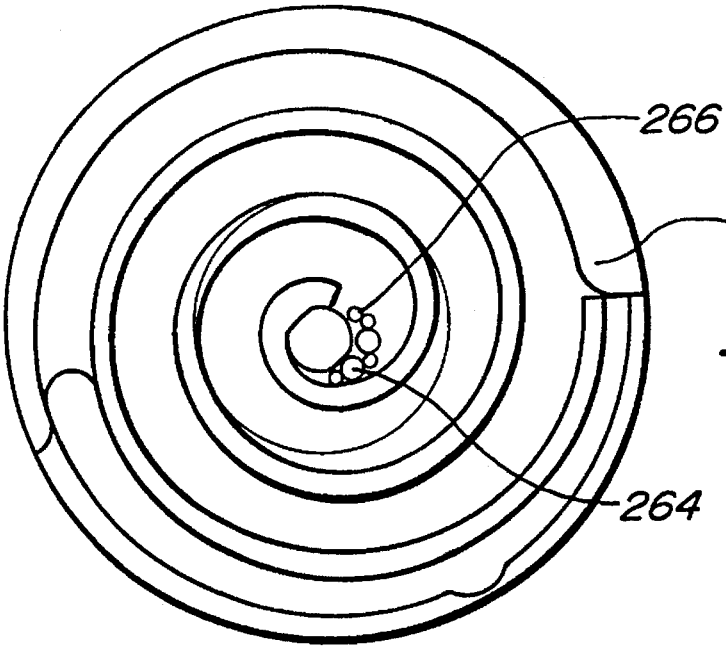
FIG. 18 is a plan view of the upper scroll of the dual rotating scroll of the scroll compressor shown in FIG. 4 according to another embodiment of the present invention.

FIG. 17 shows lower scroll 384 of compressor 300 having a plurality of discharge cavities 254 with various inserts 256 assembled within their associated cavity 254 to tailor the opening for a specified operating condition. FIG. 18 shows upper scroll 362 of compressor 300 having a plurality of discharge cavities 264 with various inserts 266 assembled within their associated cavities to tailor the opening for a specified operating condition. The use of inserts 256 within lower scroll 384 can be the same or different than the use of inserts 266 within upper scroll 362 in order to tailor the compressor to a specific requirement.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a first scroll member having a spiral wrap projecting outwardly from an end plate, said first scroll member defining a first center hole;

a first insertable member disposed within said first center hole for modifying the shape of said first center hole to define a first discharge port, said first discharge port being non-concentric with said first center hole;

a second scroll member having a spiral wrap projecting outwardly from an end plate, said scroll members being mounted for relative orbital movement therebetween with said wraps intermeshed with one another to define an outer port;

a drive member for causing said scroll members to orbit with respect to one another such that said wraps create pockets of progressively changing volume traveling between said ports whereby fluid received in one of said pockets through one of said ports is discharged through the other of said ports, said spiral wrap of said second scroll member engaging said first insertable member to define the performance of said scroll machine.

2. The scroll machine according to claim 1 wherein said second scroll member defines a second center hole and said scroll machine further comprises a second insertable member disposed within said second center hole for modifying the shape of said second center hole to define a second discharge port, said second discharge port being non-concentric with said second center port, said spiral wrap of said first scroll member engaging said second insertable member to define the performance of said scroll machine.

3. The scroll machine according to claim 2 wherein said second insertable member for modifying the shape of said second center hole comprises an insert secured within said second center hole.

4. The scroll machine according to claim 1 wherein said first insertable member for modifying the shape of said first center hole comprises an insert secured within said first center hole.

5. A scroll machine as claimed in claim 1 wherein said first scroll rotates about a first axis and said second scroll rotates about a second axis, said first axis being offset from said second axis.

6. A scroll machine as claimed in claim 1 wherein said first scroll member is an non-orbiting scroll, said second scroll member is an orbiting scroll and said motor causes said orbiting scroll to orbit about an axis with respect to said non-orbiting scroll member.

7. A scroll machine comprising:

a first scroll member having a spiral wrap projecting outwardly from an end plate, said first scroll member defining a first center hole;

a second scroll member having a spiral wrap projecting outwardly from an end plate, said scroll members being mounted for relative orbital movement therebetween with said wraps intermeshed with one another to define an outer port;

a first plug disposed within said first center hole, said first plug including a first discharge port, said first discharge port being non-concentric with said first center hole;

a drive member for causing said scroll members to orbit with respect to one another such that said wraps create pockets of progressively changing volume traveling between said ports whereby fluid received in one of said pockets through one of said ports is discharged through the other of said ports.

8. The scroll machine according to claim 7 wherein said second scroll member defines a second center hole, said scroll machine further comprising a second plug disposed within said second center hole, said second plug including a second discharge port, said second discharge port being non-concentric with said second center hole.

9. A scroll machine as claimed in claim 7 wherein said first scroll rotates about a first axis and said second scroll rotates about a second axis, said first axis being offset from said second axis.

10. A scroll machine as claimed in claim 7 wherein said first scroll member is an non-orbiting scroll, said second scroll member is an orbiting scroll and said motor causes said orbiting scroll to orbit about an axis with respect to said non-orbiting scroll member.

11. A scroll machine comprising:

a first scroll member having a spiral wrap projecting outwardly from an end plate, said first scroll member defining a first discharge port;

a second scroll member having a spiral wrap projecting outwardly from an end plate, said scroll members being mounted for relative orbital movement therebetween with said wraps intermeshed with one another to define an outer port;

a first insert disposed within said first discharge port, said first insert shifting the effective center line of said first discharge port;

a drive member for causing said scroll members to orbit with respect to one another such that said wraps create pockets of progressively changing volume traveling between said ports whereby fluid received in one of said pockets through one of said ports is discharged through the other of said ports, said spiral wrap of said second scroll member engaging said first insert to define the performance of said scroll machine.

12. The scroll machine according to claim 11 wherein said second scroll member defines a second discharge port, said scroll machine further comprising a second insert disposed within said second discharge port, said second insert shifting the effective center line of said second discharge port, said spiral wrap of said second scroll member engaging said second insert to define the performance of said scroll machine.

13. A scroll machine as claimed in claim 11 wherein said first scroll rotates about a first axis and said second scroll rotates about a second axis, said first axis being offset from said second axis.

14. A scroll machine as claimed in claim 11 wherein said first scroll member is an non-orbiting scroll, said second scroll member is a orbiting scroll and said motor causes said orbiting scroll to orbit about an axis with respect to said non-orbiting scroll member.

15. A scroll machine comprising:

a first scroll member having a spiral wrap projecting outwardly from an end plate, said first scroll member defining a first discharge hole;

a first insertable member disposed within said first discharge hole for modifying the shape of said first discharge hole, said first insertable member comprising a first insert secured within said first discharge port, said first insert including a first insert discharge port, said first insert discharge port being in non-concentric relationship to said first discharge hole when said first insert is secured within said first discharge hole;

a second scroll member having a spiral wrap projecting outwardly from an end plate, said scroll members being mounted for relative orbital movement there between with said wraps intermeshed with one another to define an outer port;

a drive member for causing said scroll members to orbit with respect to one another such that said wraps create pockets of progressively changing volume traveling between said ports where by fluid received in one of said pockets through one of said ports is discharged through the other of said ports, said spiral wrap of said second scroll member engaging said first insertable member to define the performance of said scroll machine.

16. The scroll machine according to claim 15 wherein said second scroll member defines a second discharge hole, said scroll machine further comprising a second insertable member for shifting the effective center line of said second discharge hole, said second insertable member comprising a second insert secured within said second discharge hole, said second insert including a second insert discharge port, said second insert discharge port being in non-concentric relationship to said second discharge hole when said second insert is secured within said second discharge hole, said spiral wrap of said first scroll member engaging said second insertable member to define the performance of said scroll machine.

17. A method of manufacturing a scroll machine to meet a specified performance requirement, said method comprising the steps of:

producing a first scroll member having a spiral wrap and a center port;

producing a plurality of inserts, each of said inserts being positionable within said center port, each insert being capable of adapting said center port to meet a different performance requirement for said scroll machine;

selecting one of said plurality of inserts for meeting said specified performance requirement;

securing said insert within said first center port;

assembling said first scroll member with a second scroll member having a spiral wrap; and assembling one of said first and second scroll members with a drive member.

18. A method of manufacturing a scroll machine to meet a specified performance requirement, said method comprising the steps of:

producing a first scroll member having a spiral wrap and a first center port;

producing a second scroll member having a spiral wrap and a second center port;

producing a first and second plurality of inserts, each of said first plurality of inserts being positionable within said first center port, each of said second plurality of inserts being positionable within said second center port, each set of said first and second inserts being capable of adapting said first and second center ports, respectively, to meet a different performance requirement for said scroll machine;

selecting one of said first and second plurality of inserts for meeting said specified performance requirement;

securing said first insert in said first center port;

securing said second insert in said second center port; and assembling said first and second scroll members with a drive member.

* * * * *

UNITED STATES PATENT AND TRADEMARK OFFICE

CERTIFICATE OF CORRECTION

PATENT NO. : 5,474,431

DATED : December 12, 1995

INVENTOR(S) : Steven C. Fairbanks

It is certified that error appears in the above-indentified patent and that said Letters Patent is hereby corrected as shown below:

On the title page, under Attorney, Agent, or Firm, "Harness, Dickey & Pierce" should be -- Harness, Dickey & Pierce, P.L.C. --.

Column 1, line 18, "spirodal" should be -- spiroidal--.

Column 6, line 23, "3 12" should be -- 312 --.

Column 9, line 2, "an" should be -- a --.

Column 9, line 15, "plug" should be -- insert --.

Column 9, line 16, "plug" should be -- insert --.

Column 9, line 23, after "ports" insert --, said spiral wrap of said second scroll member engaging said first insert to define the performance of said scroll machine --.

Column 9, line 26, "plug" should be -- insert --.

Column 9, line 27, "plug" should be -- insert --.

Column 9, line 35, "an" should be -- a --.

UNITED STATES PATENT AND TRADEMARK OFFICE

CERTIFICATE OF CORRECTION

PATENT NO. : 5,474,431

DATED : December 12, 1995

INVENTOR(S) : Steven C. Fairbanks

It is certified that error appears in the above-indentified patent and that said Letters Patent is hereby corrected as shown below:

Column 10, line 6, "an" should be -- a --.

Column 10, line 7, "a" should be -- an --.

Signed and Sealed this

Second Day of July, 1996

*Attest:*

*Attesting Officer*

BRUCE LEHMAN

*Commissioner of Patents and Trademarks*